United States Patent [19]

Eastman et al.

[11] 4,408,661

[45] Oct. 11, 1983

[54] CABINET COOLER HEAT EXCHANGER

[75] Inventors: George Y. Eastman, Lancaster; Donald M. Ernst, Leola; Warren E. Thomas, Lancaster, all of Pa.

[73] Assignee: Thermacore, Inc., Lancaster, Pa.

[21] Appl. No.: 306,079

[22] Filed: Sep. 28, 1981

[51] Int. Cl.[3] ..... F28D 9/00; F28F 1/42

[52] U.S. Cl. ..... 165/164; 165/122; 165/179; 165/182

[58] Field of Search ..... 165/164, 185, 179, 122, 165/182, 131, 128

[56] References Cited

U.S. PATENT DOCUMENTS

| | | | |
|---|---|---|---|
| Re. 26,853 | 4/1970 | Waldron | 165/166 |
| 326,839 | 9/1885 | Braithwaite et al. | 165/166 |
| 1,508,860 | 9/1924 | Stuart | 165/179 |
| 1,692,391 | 11/1928 | Stancliffe | 165/166 |
| 1,833,985 | 12/1931 | Chavare et al. | 165/166 |
| 2,058,022 | 10/1936 | Lebre | 165/166 |
| 2,067,597 | 1/1937 | Chilton | 165/185 |
| 2,400,617 | 5/1946 | Wheller | 165/166 |
| 3,407,876 | 10/1968 | Richardson | 165/166 |
| 3,477,502 | 11/1969 | Katz | 165/166 |
| 3,912,003 | 10/1975 | Schrade | 165/166 |
| 3,912,004 | 10/1975 | Darm | 165/166 |
| 4,053,969 | 10/1977 | Bayard | 29/157.3 |
| 4,141,412 | 2/1979 | Culbertson | 165/166 |
| 4,263,966 | 4/1981 | Östbo | 165/179 X |

FOREIGN PATENT DOCUMENTS

| | | | |
|---|---|---|---|
| 851821 | 1/1940 | France | 165/179 |
| 1117381 | 5/1956 | France | 165/131 |
| 843026 | 8/1960 | United Kingdom | 165/179 |
| 619776 | 8/1978 | U.S.S.R. | 165/179 |

*Primary Examiner*—Sheldon J. Richter
*Attorney, Agent, or Firm*—Martin Fruitman

[57] ABSTRACT

A mass produced, easily assembled heat exchanger for use in cooling a cabinet or other enclosure by convection over both ends of fins which penetrate the wall of the enclosure. The configuration of the preferred embodiment has offset fins alternating in and out of the enclosure with the overlap at the enclosure wall and each fin acting as a spacer for the adjacent ones. An alternate embodiment uses a "U" shaped spacer to wrap around the overlapping edge of each fin, thus increasing the air flow space between fins without increasing the thickness of fins.

1 Claim, 7 Drawing Figures

CABINET COOLER HEAT EXCHANGER

SUMMARY OF THE INVENTION

This invention deals generally with heat exchangers, and more specifically with the type of construction involving stacked plates or fins exchanging heat between two separate environments.

As equipment such as that used in the electronics, computing and other modern technologies becomes more and more sophisticated, and is packaged more densely, it has been necessary to design specific cooling systems to remove heat from such equipment. While it was once sufficient to merely force filtered air through the cabinetry enclosing such equipment, the newer, more sensitive, equipment cannot tolerate even the small amount of dirt and other such contaminates which pass through the air filtering system. The design of such cooling systems has, therefore, now focused upon methods of completely isolating the equipment within a cabinet or other enclosure and transferring the heat only, and not the air, out of the cabinet.

One simple approach to this problem has been to use continuous sheet metal fins separated by insulating spacers, with the fins passing entirely through the enclosure wall, and forced air circulating across the fins both inside and outside the enclosure. The heat from within the cabinet is thus used to heat the inside portion of the fins, while conduction through the fins heats their outside portions which are cooled by a forced air stream. The problem with such a configuration is that it is difficult and costly to construct and assemble, essentially because it involves a multiplicity of parts and particularly because the spacers are so much smaller than the fins, but nevertheless require exact alignment with the fins in order to assure that there will be no air leakage around or through the heat exchanger.

The present invention therefore involves several configurations of finned heat exchanger assemblies which either have no spacers between the fins, use captured spacers, that is, spacers previously attached to the fins, or manufactured integral with it, or a single assembly which acts as a spacer for the entire unit, so that assembly of the heat exchanger is a matter of merely assembling the fins and, at most, a single spacer assembly. In such a construction, assembly can be speeded up greatly and costs therefore reduced.

The preferred embodiment of the invention involves the most simple of the several configurations. The construction uses only a multiplicity of a single part, the plate or fin, which, because of its shape, location and size, acts as both a heat exchanger element and a spacer for the adjacent fins. In this configuration, the heat exchanger consists of a quantity of equal width fins, each somewhat longer than the active heat exchanger length required for one side of the heat exchanger. The fins are assembled with their side edges aligned and with alternate fins extending into opposite sides of the heat exchanger, with a small portion of the length of each fin overlapping the adjcent ones. The result is that, once the fins are rigidly clamped together, each fin acts as the spacer for the two adjacent fins which protrude into the opposite side of the heat exchanger, and the exact alignment of their side edges assures a leakproof seal around the edges. Moreover, the conduction of heat from each fin to the fins on the other side of the heat exchanger is not adversely affected compared to a single continuous fin, because the relatively large surface area of contact between the fins, where they are assembled together, more than compensates for any conduction losses due to surface irregularities. In fact, the central portion of the heat exchanger, where all the fins meet, effectively acts as a thermal bypass and equalizer if any portion of the exchanger should become clogged and lose air cooling, or if on the heat side, localized heating occurs. Since the entire central portion of the heat exchanger is one highly conductive mass consisting of the ends of the metal fins, that central portion operates essentially at a uniform temperature, and when an individual cooling fin ceases to function, for whatever reason, the other fins take over its share of the heat load. Similarly, a localized hot spot on the heated side of the heat exchanger does not cause a localized hotter fin on the cooling side, but rather the central core distributes the heat to all the cooling fins and assures more surface area is available to transfer the heat.

This same phenomenon is the basis of an alternate embodiment of the invention which uses continuous fins extending to both sides of the heat exchanger, but unlike the prior art, uses heat conductive spacers between the fins. The essential benefit of such construction is the previously described equalizing and heat bypassing action of the central portion of the heat exchanger. However, heat conductive metal spacers can also yield an advantage in construction because each fin can be preassembled to a spacer by, for instance, brazing or soldering during the fin manufacturing process, and, thus, during assembly, only large, identically shaped parts need be handled. This permits faster and less complex assembly operations.

Other embodiments of the invention involve other configurations of spacers between fins, for use when the fin-to-fin spacing desired is greater than the fin thickness, as required by the preferred embodiment. Several of these embodiments involve variations of a conductive "U" shaped spacer which can be pressed around the central core end of the fins. The use of the "U" affords a spacing of twice the thickness of the spacer material while preattaching the spacer to the fin, and, therefore, simplifying assembly by eliminating a multiplicity of parts.

DETAILED DESCRIPTION OF THE INVENTION

Figure 1:
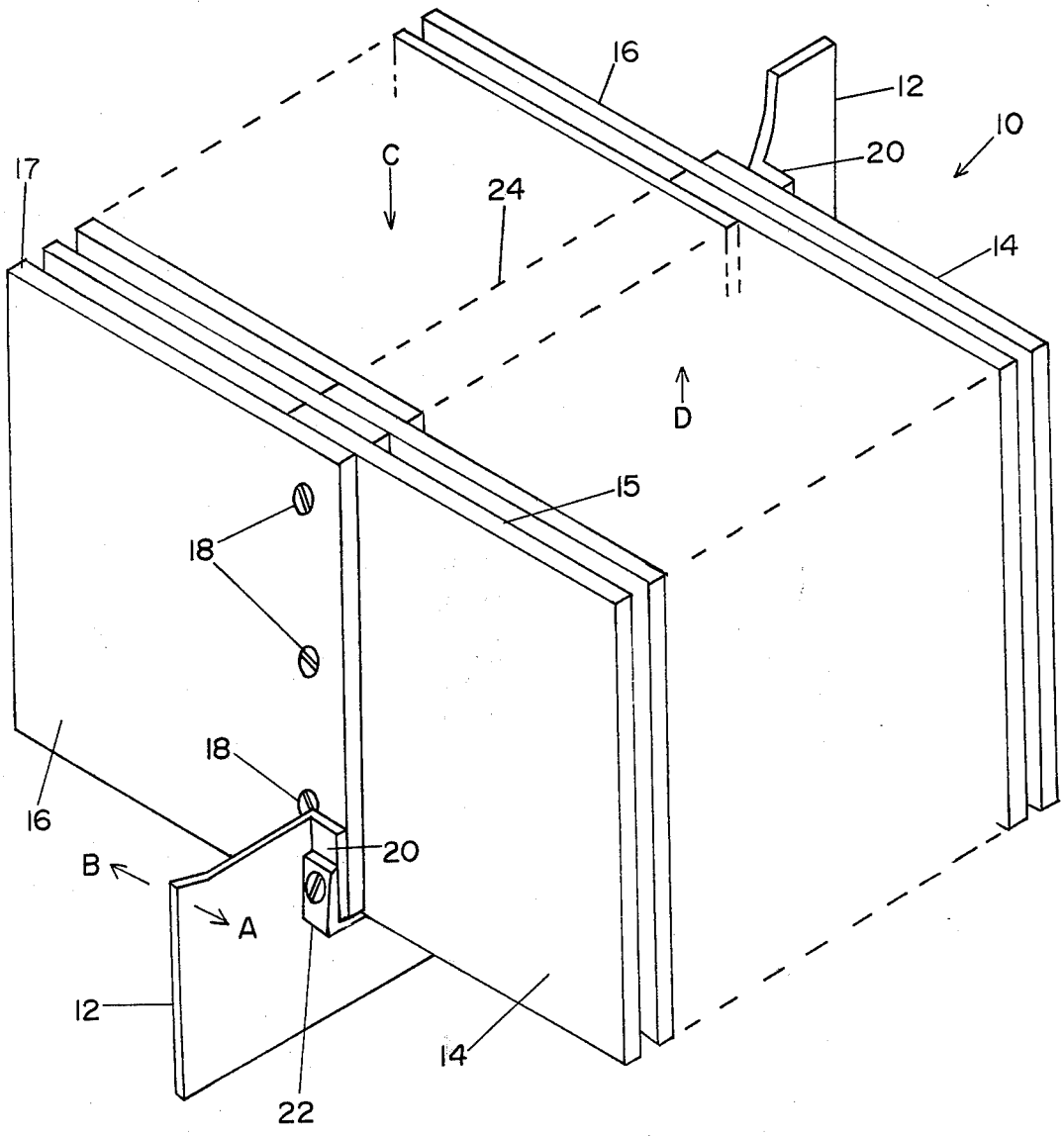
FIG. 1 is a perspective view of the preferred embodiment of a finned heat exchanger passing through an enclosure wall.

FIG. 1 shows the preferred embodiment of the invention in which heat exchanger 10, piercing enclosure wall 12, shown partially cut away, is constructed only of identical width fins 14 and 16 which alternate, fins 14 protruding out of the enclosure wall 12 in direction A, and fins 16 aiming into the enclosure in direction B.

Air streams C and D, flowing across the surface of fins 14 and 16, transfer heat to and from heat exchanger 10 by conventional processes of forced or natural convection.

The construction of heat exchanger 10 involves only the clamping of alternately directed fins 14 and 16, with their side edges 15 and 17 aligned, by means of bolts 18, and then slipping heat exchanger 10 into the opening formed in wall 12 by angles 20 and frame member 22, which are used to seal the assembly into the wall and prevent leakage between the two isolated environments.

Central portion 24 of heat exchanger 10, formed at the overlapping portions of fins 14 and 16, forms a central core which functions as a common heat conductor, and, therefore, bypasses any clogged or otherwise malfunctioning cooling fins to distribute heat to those fins which are functioning properly. Similarly the heat from any localized hot spot in the heat exchanger is transferred to all the fins on the other side which are operating as heat sinks.

Figure 2:
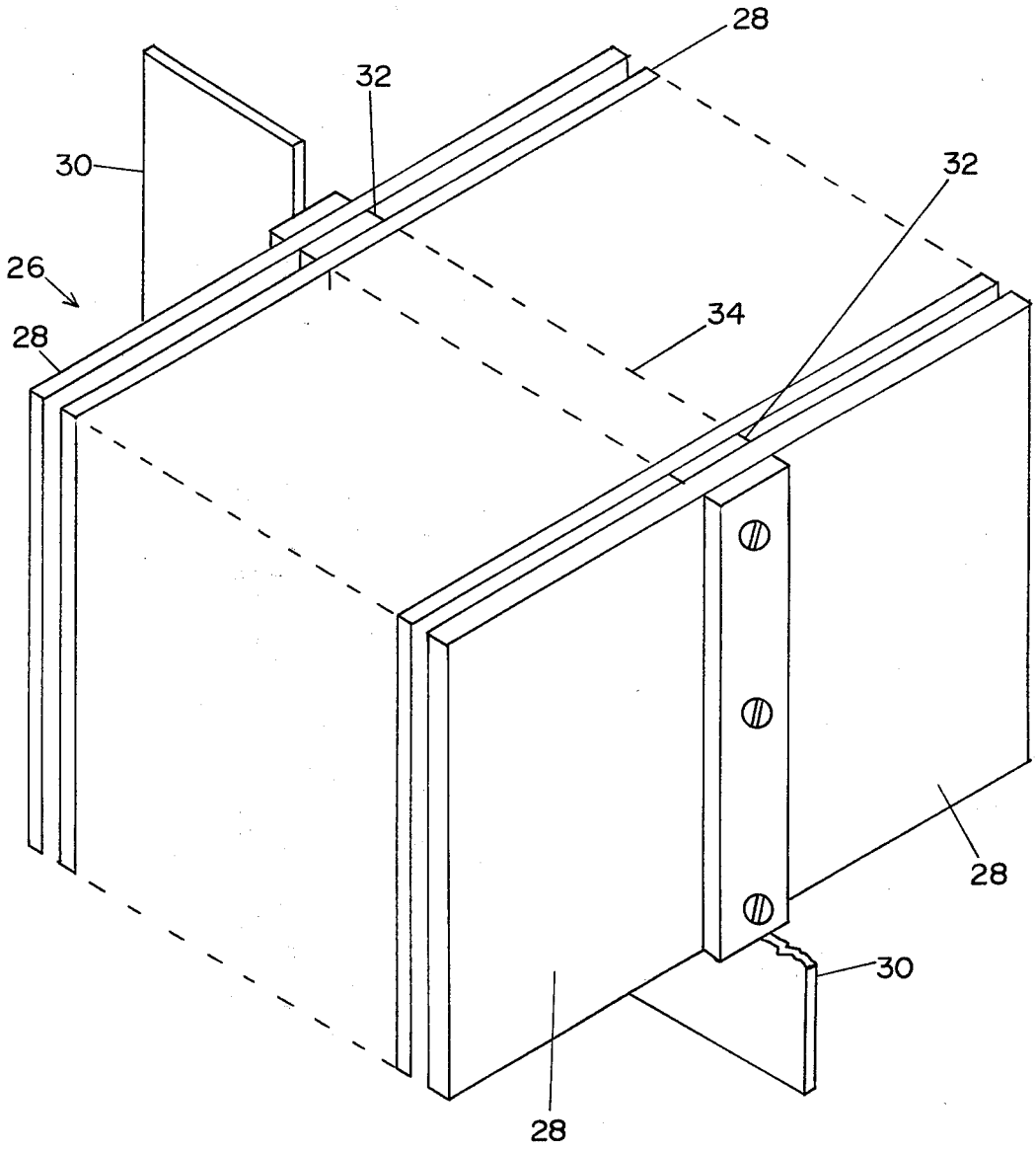
FIG. 2 is an alternate embodiment of a finned heat exchanger using continuous fins.

FIG. 2 shows heat exchanger 26 which is constructed of continuous fins 28 which pass directly from one side of the wall 30 to the other. Heat exchanger 26 functions in an improved manner over other such continuous fin heat exchangers, however, because of its construction with metal, heat conductive, spacers 32. These spacers form a conductive central core 34 which functions similarly to core 24 in FIG. 1 in bypassing and equalizing heat flow. Moreover, the use of metal spacers 32 permits the preassembly of the spacers to fins 28 by welding or soldering and thus permits rapid assembly of the heat exchanger using only a multiplicity of the same part, fin 28 with spacer 32 attached at the center. Such assembly, using only a single sized part, is more rapid and less costly whether done by hand or machine.

Figure 3:
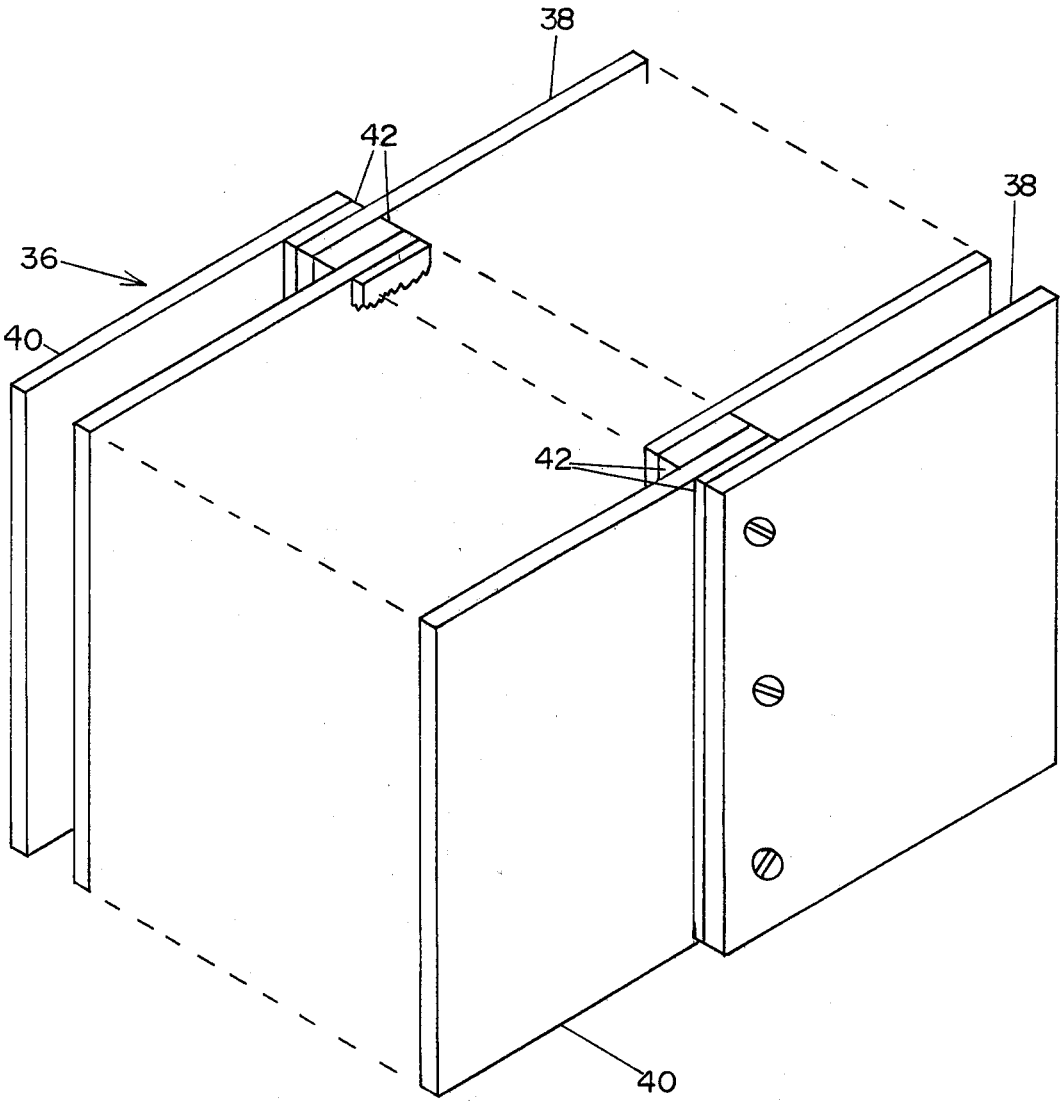
FIG. 3 is a variation of the preferred embodiment of the invention using additional spacers between fins.

FIG. 3 depicts an alternate embodiment of a conductive central core heat exchanger 36 which uses both alternately directed fins, 38 and 40, and additional heat conducting spacers 42. Heat exchanger 36 functions as do the previously described embodiments, but, by the use of additional spacers 42 of the same width as the fins, it can be constructed with wider flow spaces between the fins without the need to make the fins of heat exchanger 10, in FIG. 1, thicker and heavier.

Figure 4:
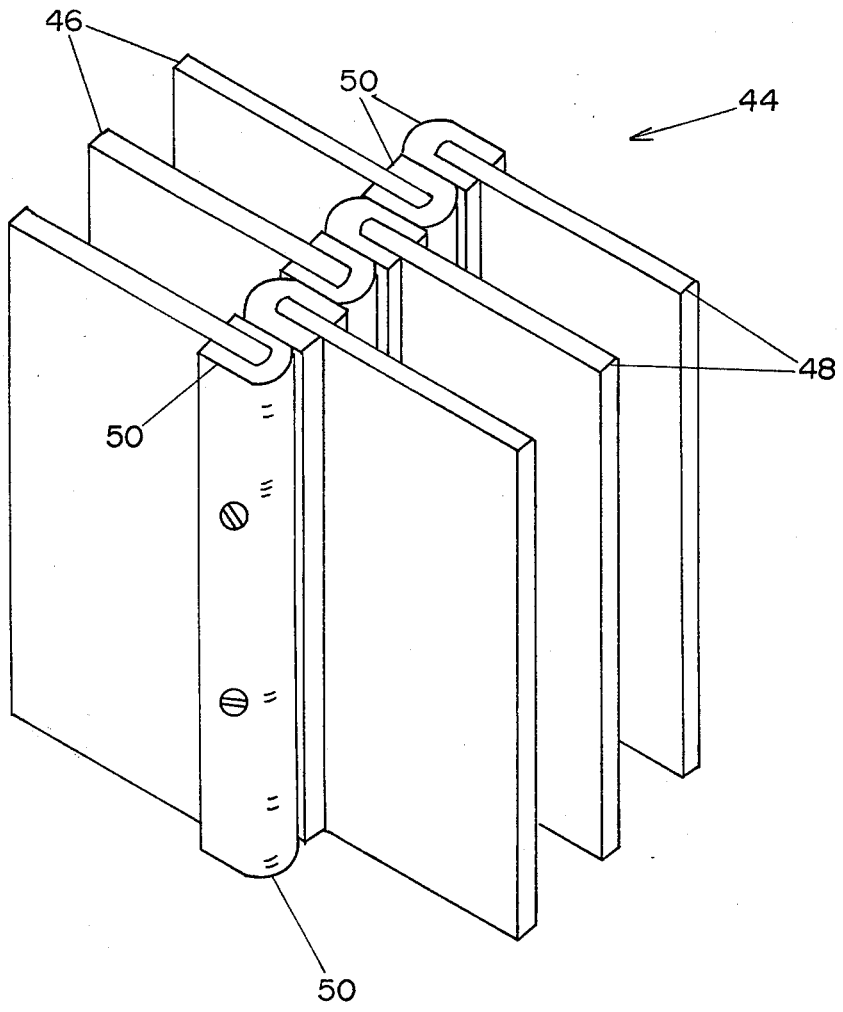
FIG. 4 is another embodiment of the invention using folded end fittings as spacers.

FIG. 4 shows another embodiment of the invention in which heat exchanger 44 is also constructed with alternately directed fins 46 and 48 and with heat conductive spacers 50 wrapped around the overlapping ends of the fins. The "U" shaped, folded configuration, of spacers 50 also permits them to be preassembled to fins 46 and 48 by a simple pressure process and the then identical assemblies can be clamped together in alternate directions rapidly and at low cost. The central conductive core of heat exchanger yields all the benefits of equalization and by passing of malfunctions, but, like the other embodiments, can be completely manufactured without any costly machining operations.

Figure 5:
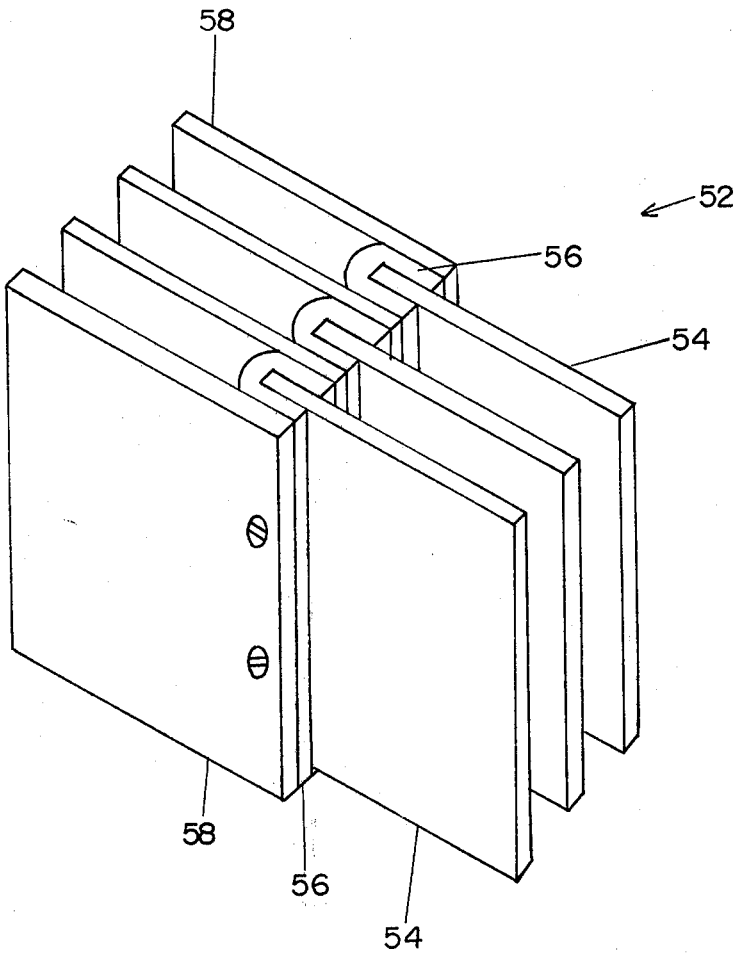
FIG. 5 is a variation of the embodiment of FIG. 4 using alternate fins without spacers.

FIG. 5 shows a simple variation of the embodiment of FIG. 4, in which heat exchanger 52 is constructed from one set of fins 54 with folded spacers 56 attached, and from a second, oppositely directed, set of fins 58 which have no spacers attached. Heat exchanger 52 functions and is assembled in the same manner as heat exchanger 44 of FIG. 4 except that its configuration results in less spacing between fins.

Figure 6:
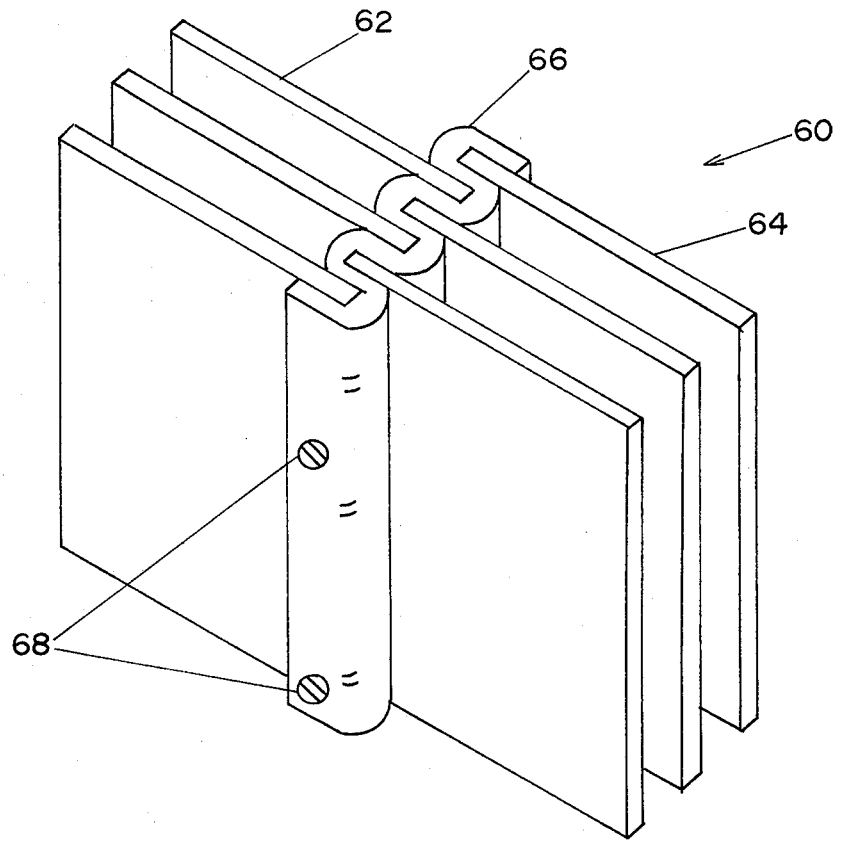
FIG. 6 is a variation of the embodiment of FIG. 4 using a continuous assembly to furnish the spacers.

FIG. 6 depicts another variation of the embodiment of FIG. 4 in which heat exchanger 60 is constructed of alternately directed fins 62 and 64 with heat conducting spacer assembly 66, a continuous, alternately folded metal sheet which enwraps and clamps the overlapping ends of a multiplicity of fins. The assembly therefore includes only a single size and shape fin, a multiplicity of which are inserted into the many folds of spacer assembly 66, and then clamped by bolts 68 into a single leaktight assembly to form heat exchanger 60.

Figure 7:
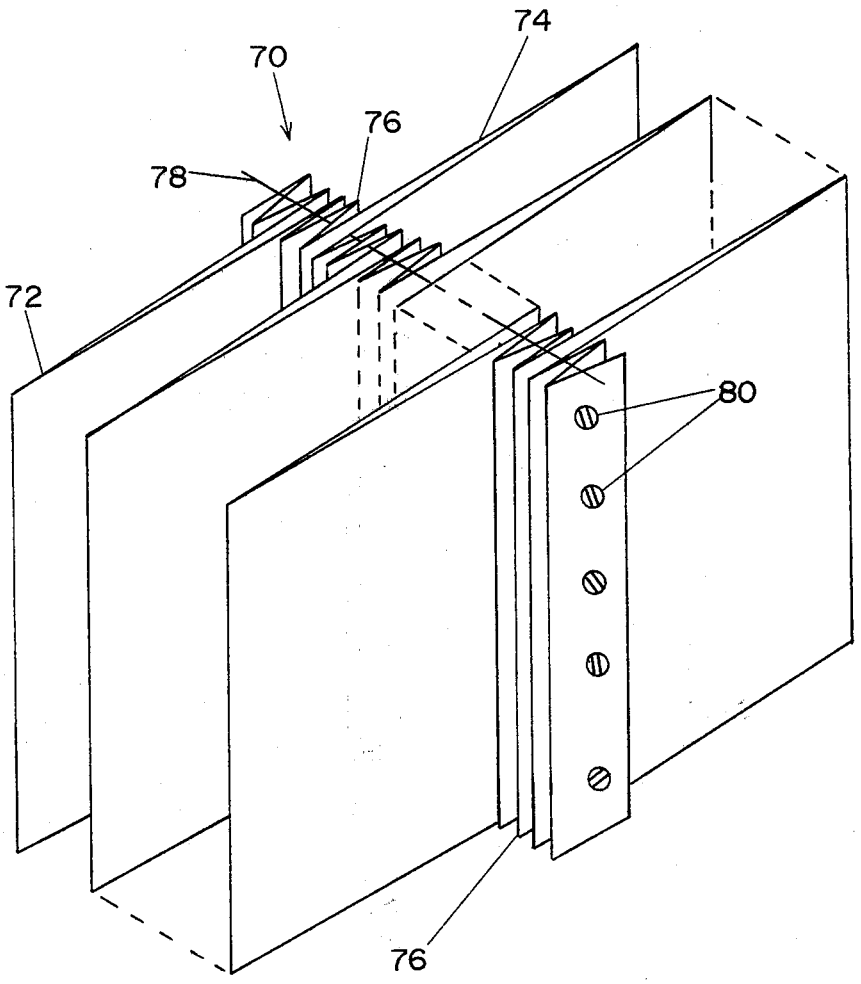
FIG. 7 is another embodiment of the invention using continuous folded metal sheet to form both the heat transfer fins and also the heat conductive spacers.

FIG. 7 depicts a further variation of the alternately directed fin heat exchanger in which heat exchanger 70 is constructed entirely of a continuous metal sheet, folded in a specific pattern to form both the heat exchange fins 72 and 74, and conductive spacer 76.

Fins 72 result from using long lengths between alternately directed folds, while the spacers result from using several short lengths between alternately directed folds. The assembly can be manufactured completely automatically, but serves as an excellent cabinet heat exchanger when compressed along the central dividing line 78 by bolts 80. Once compressed, the thermal conduction of the spacer 76 is virtually the equivalent of a solid piece of metal.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For instance, in any of the embodiments, it is possible to use different materials for individual fins of the heat exchanger to better balance the temperature distribution or accommodate different environments. Thus, in FIG. 1 it is possible to have fins 14 and 16, on opposite sides of the heat exchanger, of different materials, such as aluminum and copper.

What is claimed as new and desired to be secured by Letters Patent of the United States is:

1. In a stacked plate heat exchanger of the type comprising conductive fins extending into both a first and a second isolated environment and conducting heat between the isolated environments, the improvement comprising:

an assembly of fins, of equal width mounted together in a configuration with the planes of all fins parallel to each other and their edges in alignment, with alternate fins extending into the first environment and the remaining fins extending into the second environment, and with a portion of the length of each fin overlapping the adjacent fins, comprising a continuous folded sheet assembly forming both the heat exchange fins and heat conductive spacers between adjacent fins, by the use of long lengths of heat conductive material between alternately directed folds to form the fins and several short lengths of heat conductive material between alternately directed folds to form the spacers.

* * * * *